United States Patent [19]

White et al.

[11] 3,988,629

[45] Oct. 26, 1976

[54] THERMIONIC WICK ELECTRODE FOR DISCHARGE LAMPS

[75] Inventors: John E. White, Cleveland Heights; Ranajit K. Datta, E. Cleveland, both of Ohio

[73] Assignee: General Electric Company, Schenectady, N.Y.

[22] Filed: Oct. 7, 1974

[21] Appl. No.: 512,680

[52] U.S. Cl. ..... 313/184; 313/2 H; 313/213; 313/218; 313/229; 313/346 R

[51] Int. Cl.[2] ..... H01J 1/14; H01J 61/073; H01J 61/20

[58] Field of Search ..... 313/211, 213, 218, 310, 313/346 R, 229, 184

[56] References Cited

UNITED STATES PATENTS

| | | | |
|---|---|---|---|
| 2,162,414 | 6/1939 | Abbott | 313/211 |
| 3,437,865 | 4/1969 | Gabor et al. | 313/346 |
| 3,530,327 | 9/1970 | Zollweg et al. | 313/218 X |
| 3,619,699 | 11/1971 | White | 313/211 |
| 3,700,951 | 10/1972 | Clarke et al. | 313/184 X |

*Primary Examiner*—Palmer C. Demeo
*Attorney, Agent, or Firm*—Ernest W. Legree; Lawrence R. Kempton; Frank L. Neuhauser

[57] ABSTRACT

An improved electrode particularly suitable for operation at high current densities in vapor discharge lamps in which the pressure is upwards of 1 atmosphere. It comprises a porous matrix of refractory metal impregnated with a glassy emission material which becomes fluid or produces a fluid component at the operating temperature. The emission material comprises a low work function metal oxide and a glass forming component, preferred emission materials being lanthanum borate and lanthanum silicate.

6 Claims, 3 Drawing Figures

THERMIONIC WICK ELECTRODE FOR DISCHARGE LAMPS

The invention relates to thermionic cathodes, more particularly to thermionic cathodes suitable for operation at high current densities as required in high pressure metal vapor lamps.

BACKGROUND OF THE INVENTION

In both low pressure and high pressure gas discharge devices and lamps, low work function thermionically emitting electrodes are needed for efficient operation. In a low pressure device, a low work function may be achieved by applying a coating of an emitter such as barium oxide BaO to the surface of the electrode. Since the diffused arc terminus readily obtained in a low pressure device is not destructive of such an oxide coating, long life may be obtained. But in high intensity discharge lamps wherein the pressure is upwards of one atmosphere, the arc concentrates to a high current density and forms what is generally referred to as a hot spot which is destructive to ordinary oxide coatings. For this reason most commercial high intensity discharge lamps utilize electrodes comprising a rod or shank around which is wound a tungsten coil structure. The emission material is held as a polycrystalline powder in the interstices between turns by an overwind coil and is expected to provide fractional monolayer coverage of the tip of the shank projecting beyond the coil where it is hoped the arc terminus will attach.

In high intensity discharge lamps utilizing tungsten shank plus overwind type electrodes, the method by which the emission material migrates to the tip is not well defined. Nor is it always very effective because the arc terminus in lamps with shank plus overwind electrodes is frequently observed to attach to the coil during the cathode half cycle and to the shank tip during the anode half cycle. This "split spot" mode is destructive to the electrode because it deprives the electron-emitting cathode region of most of the heat supplied during the anode half cycle. This makes it necessary for the required heat to be produced during the cathode half cycle alone, and such requires substantially increased cathode fall voltage and an increased function of current carried by positive ions. The "split spot" mode causes loss of metal from the electrode to the wall and also tends to cause sputtering of emission material from its intended reservoir and location in the coil.

SUMMARY OF THE INVENTION

The object of the invention is to provide new and improved thermionic electrodes suitable for high pressure metal vapor lamps and not subject to the shortcomings pointed out above.

In accordance with our invention, we assure an adequate supply of emission substance at the arc terminus by constructing the electrodes of a porous matrix of refractory metal such as tungsten, and impregnating the matrix with an emission substance which is fluid at the operating temperature. A fluid emission material which wets the tungsten will tend to flow out of the pores to replace losses resulting from evaporation and ion bombardment.

Crystalline solid substances used hitherto as emission material to impregnate porous electrodes could not migrate as a fluid and migrated minimally if at all in the vapor phase. When transport of emission material is limited to the vapor phase, cathode life tends to terminate about the time emission material has been removed by the arc to a depth of 1 or 2 matrix particle diameters. Our invention overcomes these limitations and ideally we provide in the matrix pores an emission material which becomes sufficiently fluid at operating temperature and achieves a viscosity which will limit the rate of flow to exactly that required to replenish losses. The ideal is a glass or glass-like material which softens over a range of temperatures, rather than melting sharply at a single temperature to a water-like fluidity, and which is chemically compatible with the other lamp components. A water-like fluid in trying to cover the arc terminus to a constant thickness greater than required for optimum emission would probably deplete rapidly.

DETAILED DESCRIPTION

Our improved electrodes utilize a fluidizing emission material in conjunction with a porous refractory metal matrix appropriately shaped to serve as electrode in an arc lamp. Examples of refractory metal suitable for the matrix are tungsten, tantalum, molybdenum, rhenium and iridium and their alloys with one another. The electrode matrix may be shaped as a simple pellet supported at the end of an inlead, or as a pellet with a tip, or as a hollow pellet or cup-shaped member.

Figure 1:
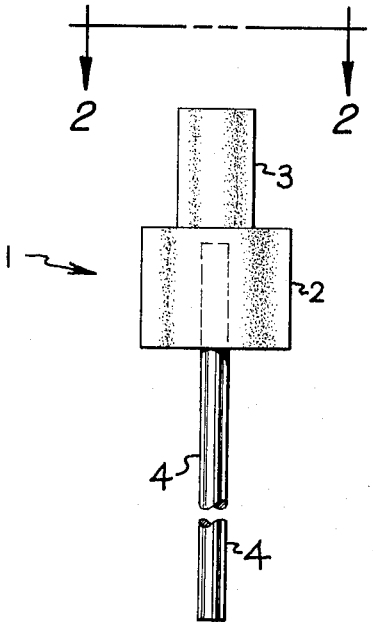
FIG. 1 is a view to an enlarged scale of a wick-type electrode embodying the invention.
Figure 2:
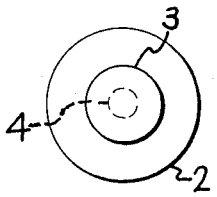
FIG. 2 is a plan view of the same electrode.

Referring to FIGS. 1 and 2, electrode 1 embodying the invention comprises a cylindrical pellet portion 2 having a projecting cylindrical tip portion 3 to which the arc terminus will attach. Both pellet and tip portions are made of porous tungsten in which the ratio of cavities to solid volume may range from 10 to 30%. The electrode matrix may be made by molding or pressing using known powder metallurgy techniques. The pellet portion is mounted on a tungsten inlead wire 4. An electrode proportioned as illustrated having the diameter of the tip portion 1 millimeter and that of the pellet portion 1.6 millimeters when provided with a fluidizing emission material compatible with the discharge filling intended for the lamp is suitable for use in a 400 watt size high intensity discharge lamp.

Figure 3:
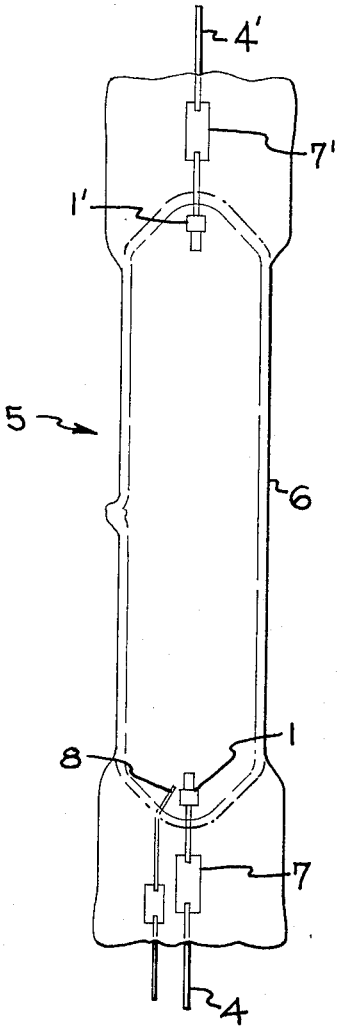
FIG. 3 shows the arc tube of a high pressure metal vapor lamp utilizing the improved electrodes according to the invention.

With specific reference to the embodiment of the invention illustrated in FIG. 3, there is shown an arc tube for a high pressure vapor discharge lamp. The arc tube 5 comprises an envelope 6 of fused silica having wick-type electrodes 1,1' such as illustrated in FIG. 1 mounted in opposite ends. The electrode inleads 4,4' include molybdenum foil portions 7,7,' which are pinch sealed through the ends of the tube. A starting electrode 8 which may be simply a fine tungsten wire is sealed through one end of the envelope and positioned proximate to one of the main electrodes. In a known type of metal halide lamp, the arc tube contains an inert gas such as argon at a low pressure for starting purposes, a quantity of mercury which is all vaporized during operation, and usually an excess of various metal halides which are important to efficiency and spectral quality. One well-known metal halide charge comprises the iodides of sodium, thallium and indium. In actual use the arc tube 5 is supported within a sealed outer envelope as illustrated for instance in U.S. Pat. No. 3,619,699 — White.

Emission material suitable for fluid impregnated electrodes in accordance with our invention comprise various oxides of low vapor pressure and low work function with suitable fluidizing or glass forming additions. In the case of mercury vapor lamps, the low work function oxides may include BaO, SrO, and CaO. These are not suitable for metal halide lamps for which other oxides must be used such as $ThO_2$, $Y_2O_3$, and the oxides of the rare earth metals in the series extending from lanthanum to lutetium, in particular $La_2O_3$ and $Dy_2O_3$. The glass forming component may be for example $SiO_2$, $B_2O_3$ or $GeO_2$. In addition other network modifying oxides such as $Al_2O_3$, MgO, ZnO, etc., may also be incorporated to optimize the glass properties. To obtain desired characteristics, various combinations of two or more of these oxides including of necessity a network forming oxide and a refractory low work function oxide, and optionally a network modifying oxide, can be used, so that the resulting glass phase may belong to a binary, ternary, quaternary, etc. system. Preferred materials are lanthanum borate $LaBO_3$ and lanthanum silicate $LaSiO_3$.

In accordance with our invention the emission material is provided with migratory properties by fluidizing the low work function oxides and impregnating a matrix of refractory metal with the material. Some materials fluidize in bulk but this is not essential. Other materials soften at high temperature but without bulk migration. Instead a fluid component separates out and flows towards the surface providing activation while the bulk remains in place. A material which exhibits this property is lanthanum borate $La_2O_3.B_2O_3$. Probably what happens is that the lanthanum borate separates into two components having different ratios of lanthanum oxide to boric oxide of which only one may be in the liquid phase depending upon the temperature.

What we claim as new and desire to secure by Letters Patent of the United States is:

1. A high pressure electric discharge lamp comprising a light-transmitting envelope having refractory metal electrodes sealed into opposite ends and containing an ionizable medium including mercury, metal halide and an inert gas at low pressure, said electrodes comprising a porous tungsten matrix impregnated with an emission material which fluidizes at the electrode operating temperature, said emission material comprising a low work function oxide selected from the group consisting of $ThO_2$, $La_2O_3$, $Dy_2O_3$, $Y_2O_3$, and mixtures thereof and a glass forming component selected from the group consisting of $SiO_2$, $B_2O_3$, $GeO_2$ and mixtures thereof.

2. A lamp as in claim 1 wherein the emission material is lanthanum borate $LaBO_3$.

3. A lamp as in claim 1 wherein the emission material is lanthanum silicate $LaSiO_3$.

4. An electrode for an arc discharge lamp comprising a porous refractory metal substrate and a glassy emission material impregnating the pores thereof, said emission material comprising a low work function metal oxide and a glass forming component which together have the property of producing a fluid at high temperature which migrates to the surface of the matrix and provides activation, said low work function oxide being selected from the group consisting of BaO, SrO, and CaO and the glass forming component being selected from the group consisting of $SiO_2$, $B_2O_3$ and $GeO_2$.

5. An electrode for an arc discharge lamp comprising a porous refractory metal substrate and a glassy emission material impregnating the pores thereof, said emission material comprising a low work function metal oxide and a glass forming component which together have the property of producing a fluid at high temperature which migrates to the surface of the matrix and provides activation, said low work function oxide being selected from the group consisting of $ThO_2$, $La_2O_3$, $Dy_2O_3$ and $Y_2O_3$ and the glass forming component being selected from the group consisting of $SiO_2$, $B_2O_3$ and $GeO_2$.

6. An electrode as in claim 5 wherein the emission material comprises in addition a network modifying oxide selected from the group consisting of $Al_2O_3$, MgO and ZnO.

* * * * *